United States Patent [19]

Shinohara et al.

[11] 4,075,069

[45] Feb. 21, 1978

[54] PROCESSES FOR PREVENTING THE GENERATION OF A MIST OF ELECTROLYTE AND FOR RECOVERING GENERATED GASES IN ELECTROWINNING METAL RECOVERY, AND ELECTRODES FOR USE IN SAID PROCESSES

[75] Inventors: Yukio Shinohara, Tokyo; Kuniki Ueno, Hino, both of Japan

[73] Assignee: Mitsui Mining & Smelting Co., Ltd., Tokyo, Japan

[21] Appl. No.: 669,104

[22] Filed: Mar. 22, 1976

[30] Foreign Application Priority Data

Apr. 10, 1975 Japan ..... 50-43516
Apr. 10, 1975 Japan ..... 50-43517

[51] Int. Cl.[2] ..... C25C 1/12

[52] U.S. Cl. ..... 204/106; 204/DIG. 1; 204/114; 204/278; 204/282

[58] Field of Search ..... 204/278, DIG. 1, 282, 204/106, 114

[56] References Cited

U.S. PATENT DOCUMENTS

| | | | |
|---|---|---|---|
| 264,927 | 9/1882 | Cassel | 204/282 X |
| 831,474 | 9/1906 | Roberts | 204/282 X |
| 2,710,832 | 6/1955 | Harr | 204/DIG. 1 |
| 3,200,055 | 8/1965 | Scacciati | 204/282 X |
| 3,821,097 | 6/1974 | Ettel | 204/106 |
| 3,948,747 | 4/1976 | Cordiano et al. | 204/DIG. 1 X |

FOREIGN PATENT DOCUMENTS

| | | | |
|---|---|---|---|
| 1,022,005 | 3/1966 | United Kingdom | 204/DIG. 1 |

*Primary Examiner*—Arthur C. Prescott
*Attorney, Agent, or Firm*—Armstrong, Nikaido & Marmelstein

[57] ABSTRACT

The present invention provides a process for preventing the generation of a mist of electrolyte in the electrowinning metal recovery which is carried out by using an aqueous solution of a metal salt as an electrolyte and an insoluble electrode, said process being characterized in that said electrode is surrounded with an inert woven fabric screen over the area of the electrode plate from a position above the level of electrolyte to the bottom in parallel with and in the vicinity of the electrode plate; and the electrode for use in recovering a metal by the electrolysis. Furthermore, the present invention provides a means for recovering gas generated on the electrode, said means being characterized in that part of an electrode beam except for an electric contact part and such electrode plate surrounded with the inert woven fabric screen as mentioned above (this combination is referred to as an electrode plate assembly hereinafter) are covered and sealed with an inert, gas-impermeable film in such a manner that the film is close to the opposite sides of the screen and the lower ends of the film is extended below the level of electrolyte, thereby recovering gases generated on the electrode through a gas outlet; and a process using said means.

7 Claims, 5 Drawing Figures

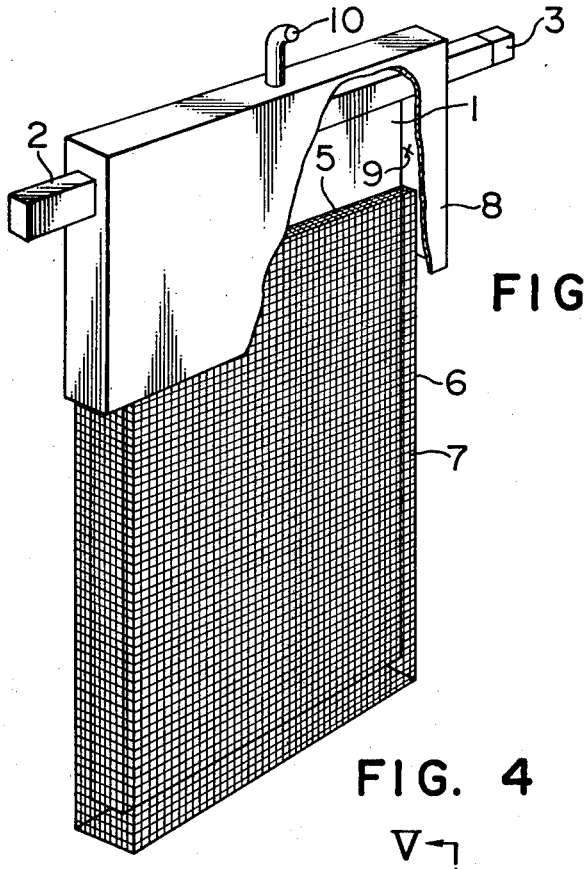
FIG. 3
FIG. 4
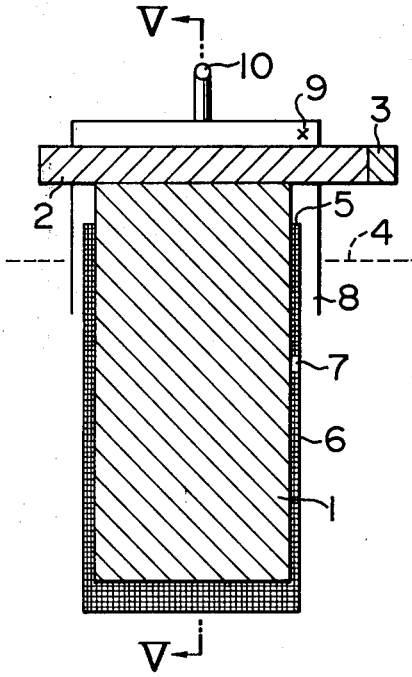
FIG. 5
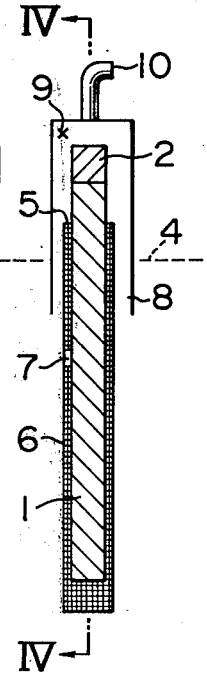

PROCESSES FOR PREVENTING THE GENERATION OF A MIST OF ELECTROLYTE AND FOR RECOVERING GENERATED GASES IN ELECTROWINNING METAL RECOVERY, AND ELECTRODES FOR USE IN SAID PROCESSES

The present invention relates to an improvement in producing a metal by the electrowinning metal recovery method, more particularly to the improvement which makes it possible to inhibit a mist of electrolyte produced with generated gases from being scattered and to recover the generated gases, and to the improved electrode plate.

The electrowinning metal recovery method is a general term for various methods wherein the electrolysis is carried out by using an aqueous solution of a metal salt as an electrolyte and an insoluble electrode as an anode to deposit a highly pure metal on a cathode. This method is now applied broadly in various cases, i.e., metal refining, electrolytic metal recovering from ores or metal plating. For example, a highly pure metal such as zinc, cadmium, copper, cobalt, manganese, chromium, or manganese dioxide is produced by this method.

In this method, the electrolysis results in the generation of tiny bubbles from electrodes and the formation of a mist of electrolyte when the bubbles leave the surface of the electrolyte. This mist is scattered in a cell room to conspicuously pollute the working environment.

In order to inhibit the generation of a mist, to an electrolyte there has hitherto been added an additive such as soy bean protein, glue, cresol or sodium silicate to change the nature of the electrolyte, or an electrolyzing cell has been sealed and generated gas accompanied with mist has been conducted from the cell to the outdoors through a suitable duct. In the former, however, an additive which is not harmful to the electrolysis is added to an electrolyte, but there is a little influence of the additive on the electrolysis which is impossible to avoid, and the treatment of the electrolyte is complicated. Further, the generation of mist is not adequately inhibited. In the latter case, the pollution of a working environment with the mist is completely inhibited but there is a demerit that an operation is complicated in lifting electrodes and stripping off a precipitated metal.

The object of the present invention is to provide a very simple process for inhibiting the generation of a mist without inconvenience in operation, a process for recovering a generated gas while preventing the generation of a mist, and an electrode for use in such processes.

According to the present invention, there is provided a electrowinning metal recovery method, wherein the electrolysis is carried out by using an aqueous solution of a metal salt as an electrolyte and an insoluble anode plate to deposit a metal on a cathode, said method being characterized in that said anode plate is surrounded with an inert woven fabric screen having an opening of about 5 mm to about 0.04 mm and said screen is extended above the level of electrolyte in parallel with and close to said anode plate, thereby preventing the generation of mist, and further there is provided an anode plate for use in the electrowinning metal recovery, which is covered with an inert woven fabric screen having an opening of about 5 mm to about 0.04 mm from the area above the level of electrolyte to the bottom area.

Furthermore, according to the present invention, there are provided a generated gas recovery method and an anode plate for use in the method, wherein the anode plate is covered with the inert woven fabric screen as mentioned above and, further, part of an anode beam except for an electric contact part, and part of the anode plate above the level of electrolyte are sealed with an inert, gas-impermeable film in such a manner that the lower ends of the film are extended, close to the opposite surface of the woven fabric screen with respect to the anode plate, to underneath the level of electrolyte, and thus a gas generated on the anode is recovered from an outlet provided on the film.

The present invention will be illustrated below by the electrolytic recovery of zinc.

As an electrolyte a sulfuric acid aqueous solution containing zinc sulfate dissolved therein is prepared. Cathode plates of aluminum and insoluble anode plates of lead containing about 1% silver are alternately suspended in an electrolyzing cell. The electrolysis is then carried out at a convenient current density to deposit metallic zinc on the cathode plates for a given period of time. Thereafter, the cathode plates are lifted up from the cell and the deposited zinc is recovered. It is observed that a hydrogen gas is generated on the cathode plates and an oxygen gas on the anode plates during the electrolysis. The generated gases rise up along the electrodes in the electrolyzing cell in the form of tiny bubbles, and these bubbles break and the gases diffuse on the surface of the electrolyte when the bubbles leave the surface, so that the surface of the electrolyte is opacified. The breakage of the bubbles is accompanied by the generation of a mist.

The present invention will be explained mainly as to an anode, because a cathode is subjected to the stripping treatment for each given period of time, but it should be taken in account that the present invention is not limited to the anode only.

The feature of the present invention is that the effective area of the anode is covered with a woven fabric screen which is provided close to and in parallel with the anode between the anode and the cathode, whereby the tiny bubbles of a generated gas are integrated in bubbles having an increased volume, which rise up in a space between the woven fabric screen and the anode and strike against the upper end of the woven fabric screen which is extended above the level of electrolyte, so that said bubbles readily break and a generated gas is prevented from being diffused on the surface of the electrolyte. Thus, there is observed no occurring of opacification nor generation of mist.

The woven fabric screen used may be made of whatever material is inert, i.e., not reactive with respect to an electrolyte. Since usual electrolytes including that used for electrowinning zinc are acidic with sulfuric acid, hydrophobic polymers such as polyethylene, polypropylene, polyvinyl chloride and polyvinylidene chloride may be used. The mesh size of the woven fabric screen varies depending upon a kind of gas, an amount of gas generated and whether there arise electrolyzing deposits of different metals on electrodes, i.e., impurities (manganese contained in an ore in the case of electrolyzation of zinc) which are deposited on an anode but it ranges from 4 to 325 Tyler mesh (an opening 4.7 to 0.04 mm) and is appropriately selected. Generally, when the mesh size is too coarse the volume of bubbles integrated is not adequately increased and bubbles pass through meshes to the side of a cathode with producing an opaque surface of electrolyte, so that the generation of a mist is not adequately inhibited. On the other hand, when the mesh size is too fine the cell voltage becomes elevated during operation for a long period of time and, as a result, the current efficiency becomes lowered and the mesh is blocked by oxides of different metals deposited during electrolysis. Thus, the mesh size is limited to about 325 mesh. The mesh size is within the range mentioned about but preferably ranges from 48 to 200 Tyler mesh (an opening of about 0.3 to 0.074 mm). When the deposition of crust manganese, calcium or magnesium on an anode is considered, preferably a woven fabric screen having relatively coarse mesh size is used in the interior of an electrolyte and another woven fabric screen having a relatively fine mesh size is added to or placed over the former woven fabric screen in the vicinity of the surface of electrolyte. This makes it possible to achieve the object of the present invention with high efficiency without lowering the current efficiency since said woven fabric screens do not permit the escape of bubbles. Surprisingly, the inventors have discovered that in the case of the electrolytic recovery of zinc a woven fabric screen having a size of 200 or greater Tyler mesh does not substantially bring about the reduction of the current efficiency. Even a woven fabric screen having a mesh size of such a degree that part of bubbles of gases generated is allowed to pass through meshes may be used as far as the bubbles passing through meshes are in such an amount that they do not render the surface of electrolyte opaque.

Between an anode and a cathode there is provided a woven fabric screen in the vicinity of the anode, but there is desirably present a little space. The maximum size of the space is 15 mm, preferably 1 to 2 mm. Such space permits integrating bubbles in greater volume and bubbles to rise up smoothly therein.

When the woven fabric screen is extended so that the upper end thereof is above the surface of electrolyte the mist entrapping effect of the woven fabric screen is expected to be greater. Such extension of the woven fabric screen above the level of electrolyte prevents integrated bubbles from diffusing on the surface of the electrolyte. The bubbles strike against the woven fabric screen to be readily broken and diffusion of gases in air occurs without mist produced. Even if such diffusion is accompanied with a small amount of an electrolyte, it strikes against the extended woven fabric screen and there is collected by adsorption.

According to the present invention, in order to provide a woven fabric screen between an anode and a cathode, it may be mounted in parallel with the anode by an appropriate mounting means attached to an electrolyzing cell, so that a convenient space is formed between the anode and the woven fabric screen, but advantageously an anode is placed in a bag of a woven fabric screen. More desirably, a cylindrical woven fabric screen, opposite sides of which are open, is used and the upper portion of the woven fabric screen is fixed to prevent falling. The woven fabric screen may be fixed to an anode by an optional way of, for example, tightening the upper portion of the woven fabric screen with a string or fixing the woven fabric screen to recesses provided on an anode.

Another characteristic aspect of the present invention is that a portion of an anode appearing above the level of electrolyte is sealed with a film, thereby entrapping gases diffusing into air mainly from the space between the woven fabric screen and the anode. These gases are removed from a gas outlet. This sealing is made over the substantially entire area of an anode plate assembly above the level of electrolyte, but part of said area including an electric contact part of an anode beam is not sealed.

As a film for the sealing, there are used films made from a material which is gas-impermeable and inert to an electrolyte, e.g., polyethylene, polypropylene, polyvinylidene or polyvinyl chloride. In order to seal an anode plate assembly appearing above the level of electrolyte a film formed in a particular shape may be used but the upper portion of an anode plate may be simply covered by a film, which is then fixed with an adhesive. The film is extended along the outside surface of a woven fabric screen, so that the lower ends of the film are placed in an electrolyte. Thus, gases from bubbles of an increased volume rising up through a space between the woven fabric screen and the anode, which gases are not accompanied with the mist of the electrolyte, can be entrapped in a sealed chamber defined by the film and the surface of the electrolyte between the outer surfaces of the woven fabric screen. Furthermore, gases generated at a cathode can be prevented by the film from coming into the anode area. The entrapped gases are removed from an outlet by the pressure of said gases or the pumping and transferred to a well-known purifying process.

The present invention provides an anode plate useful in the present invention, that is, an anode plate for use in the electrowinning recovery of a metal, characterized in that said anode plate is covered at the effective surfaces thereof including the portion appearing above the level of electrolyte with a woven fabric screen which has an opening of about 5 mm to about 0.04 mm and is inert to the electrolyte; the assembly of the anode plate and the woven fabric screen appearing above the level of an electrolyte is further covered with an inert, gas-impermeable film except for the electric contact portion of the anode beam, so that the film is close to the outer surface of the woven fabric screen and extended below the level of electrolyte to form a sealed chamber; and said film is provided with a gas outlet.

According to the present invention, a metal can be recovered by the electrolysis with avoiding the generation of a mist but the reduction of the current efficiency by a very simple way. At the same time, a by-product of gases is possible to recover and utilize. Thus, the present invention can employ electric energy for electrolysis with high efficiency and is excellent in economy.

The anode plate of the present invention will be illustrated referring to the attached figures.

FIG. 3 is a sketch of the anode plate assembly of FIG. 1 covered with a film.

FIGS. 4 and 5 show cross-sectional front and side views of the assembly of FIG. 3.

Figure 1:
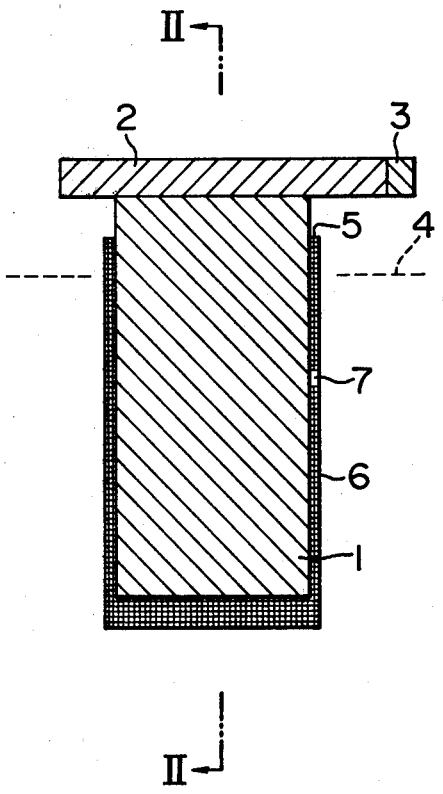
FIGS. 1 and 2 show cross-sectional front and side views, respectively, of an assembly according to the present invention.
Figure 2:
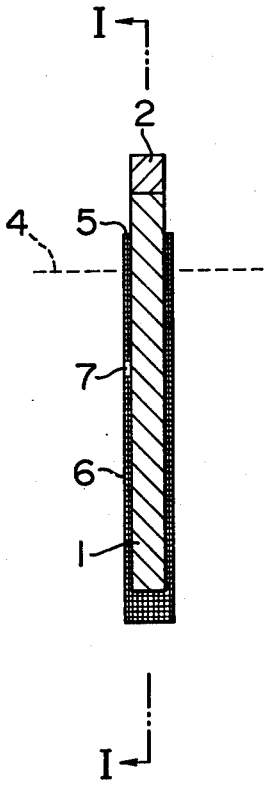

A usual anode plate consists of an anode 1 and an anode beam 2 for supporting the anode 1 to be suspended in an electrolyzing cell, which beam has an electric contact part 3 at an end thereof. The anode plate according to the present invention comprises an anode 1, the opposite sides of which are covered at the area from a position 5 slightly above the level of electrolyte 4 to the bottom of the anode, with an inert woven fabric screen 6 having an opening of about 5 mm to about 0.04 mm in such a manner that a space 7 between the woven fabric screen and the surface of the anode is 1 to 2 mm. Furthermore, the anode, the anode beam except for the electric contact part and the woven fabric screen are covered with an inert, gas-impermeable film 8, which is extended below the level of electrolyte 4 to form a sealed chamber 9, thereby preventing the incorporation of air in generated gases. The top of the film is provided with a gas outlet 10, from which gases collected in the chamber 9 are removed.

The present invention has been explained with respect to the anode for the electrowinning of zinc. The same thing should be referred to in the collection of a hydrogen gas generated at a cathode.

Furthermore, the present invention will be illustrated below by some examples but should not be limited to these examples.

EXAMPLE 1

Four anode plates of lead containing 1% silver and three cathode plates of aluminum were alternately suspended in an electrolytic cell at the distance of 37.5 mm. The electrolysis was carried out under the following conditions. The anode plates were covered with a net bag of polyethylene having a mesh size of 200 mesh so that the space between the anode and the net bag was 3 ± 2 mm. The mouth of the bag was fixed to the anode above the level of electrolyte. After 24 hours elapsed from the start of electrolysis there was found little change in the cell voltage. The cell voltage was within a range of 3.48 to 3.50 V. Zinc was deposited on the cathode plates. The current efficiency was calculated to be 92.0%.

Current density at anode: 800 $A/m^2$
Time of electrolysis: 24 hours
Composition of electrolyte: 60 ± 2 g/l Zn, 118 ± 2 g/l $H_2SO_4$
Temperature of electrolyte: 35 ± 2° C
Size of anode (Number): 240 mm (width) × 340 mm, (length) × 10 mm (thickness) (4)
Size of cathode (Number): 270 mm (width) × 410 mm, (length) × 5 mm, (thickness) (3)
(These sizes are based on an immersed area.)

Bubbles of an oxygen gas generated on the anode surface during electrolysis rose up through a space between the net of polyethylene and the anode and grew larger gradually. These bubbles did not opacify the surface of the electrolyte and were broken. The gas from the bubbles diffused in air through the upper end of the net of polyethylene above the level of electrolyte. Then the surrounding atmosphere was sampled by a suction pump at a position of 10 cm above the surface of the electrolyte to adsorb a mist on a filter paper. This filter paper was immersed in distilled water for 24 hours. The distilled water was subjected to the quantitative analysis by the atomic-absorption spectroscopy. As a result, the amount of the mist was 37 $mg/Nm^3$.

EXAMPLE 2

The procedure of EXAMPLE 1 was repeated. However, a net bag of polyethylene having a mesh size of 24 mesh was used instead of the net bag of 200 mesh. The cell voltage was approximately constant within a range of 3.48 to 3.50 V during electrolysis. The current efficiency was 92%. Zinc was deposited.

Bubbles of gases generated grew larger as they were rising up in a space between the anode and the net bag. The major part of the bubbles rose up in the space but part of the bubbles passed through the net bag in an electrolyte to the side of a cathode and rose up along the net. The bubbles which rose up along the outside and inside of the net were broken without opacifying the surface of the electrolyte. The surrounding atmosphere at a position of 10 cm above the surface of the electrolyte was sampled by a suction pump. The amount of a mist in the sampled atmosphere was determined as in EXAMPLE 1. As a result, it was 38 $mg/Nm^3$.

EXAMPLE 3

The procedure of EXAMPLE 1 was repeated. However, the net bag of polyethylene of 48 mesh was used instead of the net bag of 200 mesh. The cell voltage was within a range of 3.48 to 3.50 V. The efficiency of electric current was 92%. The major part of generated gas rose up in the space. No generation of a mist was found.

COMPARATIVE EXAMPLE

The procedure of EXAMPLE 1 was repeated. However, the anode was not covered with a net. The cell voltage was approximately constant within a range of 3.48 to 3.50 V. Zinc was deposited at a current efficiency of 92%.

Tiny bubbles of an oxygen gas generated at the surface of an anode rose up along the anode as they were, and rapidly diffused. These bubbles opacified the surface between the anode and cathode. The ambient atmosphere at a position of 10 cm above the surface of an electrolyte was sampled by a suction pump to adsorb a mist on a filter paper. The filter paper was immersed in distilled water for 24 hours. The amount of the mist was found to be 390 $mg/Nm^3$ by the quantitative analysis with the atomic-absorption spectroscopy.

EXAMPLE 4

An anode 1 of lead containing 1% silver was covered with a polyethylene woven fabric screen 6 of 200 Tyler mesh, so that the space 7 between the anode and the woven fabric screen was 2 mm in width. The assembly above the level of electrolyte was interrupted from atmosphere with a film of polyvinyl chloride 8 having a thickness of 0.2 mm. The thus formed chamber 9 was provided at the top thereof with a gas outlet 10. Four anode plates and three cathode plates were alternately suspended in an electrolytic cell in which zinc was electrolytically recovered under the following conditions.

Current density at anode: 700 $A/m^2$
Time of electrolysis: 24 hours
Composition of electrolyte: 60 ± 2 g/l Zn, 118 ± 2 g/l $H_2SO_4$
Temperature of electrolyte: 35 ± 2° C
Size of anode: 240 mm (width) × 340 mm, (length) × 10 mm, (thickness)
Size of cathode: 280 mm (width) × 410 mm, (length) × 5 mm (thickness)
(These sizes are based on an immersed area.)

Zinc was deposited on the cathode plates at a current efficiency of 92%. An oxygen gas (purity: 96%) was removed from a gas outlet 10. Impurities in the gas were 2.4% vol. hydrogen and 1.6% vol. nitrogen. The cell voltage was approximately constant at 3.40 V.

What is claimed is:

1. A process for preventing the generation of a mist of electrolyte in the electrowinning metal recovery which is carried out by using an aqueous solution of a metal salt as the electrolyte and insoluble electrode plates to deposit the metal on a cathode without substantially reducing current efficiency, characterized in that the electrode plate(s) is provided with an inert woven fabric screen having an opening of about 5 to about 0.04 mm. in such a manner that the woven fabric screen is in parallel with and close to the electrode plate(s), and the woven fabric screen is extended in such a manner that the upper end of the woven fabric screen is above the level of electrolyte.

2. The process of claim 1, wherein said inert woven fabric screen is made of polyethylene, polypropylene, polyvinyl chloride or polyvinylidene chloride.

3. The process of claim 1, wherein the space between the electrode plate(s) and the inert woven fabric screen is less than 15 mm, preferably 1 to 2 mm.

4. The process of claim 1 in which said metal is zinc.

5. A process for recovering generated gases in the electrowinning metal recovery which is carried out by using an aqueous solution of a metal salt as an electrolyte and an insoluble electrode plate(s) to deposit the metal on a cathode without substantially reducing current efficiency, characterized in that an inert woven fabric screen having an opening of about 5 to about 0.04 mm. is provided in parallel with and close to the electrode surface in such a manner that the upper end of said woven fabric screen is above the level of electrolyte; the electrode plate, the woven fabric screen and part of a beam except for an electric contact part are sealed with the surface of the electrolyte and a film which is inert to the electrolyte and gas-impermeable; and the film above the level of electrolyte is provided with a gas outlet from which the gases generated on the electrode plate are recovered.

6. The process of claim 5, wherein said inert woven fabric screen is made of polyethylene, polypropylene, polyvinyl chloride or polyvinylidene chloride.

7. The process of claim 5, wherein the space between said electrode plate and said inert woven fabric screen is less than 15 mm, preferably 1 to 2 mm.

* * * * *